US005593038A

United States Patent [19]

Lyon

[11] Patent Number: 5,593,038

[45] Date of Patent: Jan. 14, 1997

[54] WRINKLE PREVENTING METHOD OF PACKING GARMENTS FOR TRANSPORTATION OR STORAGE

[76] Inventor: John Lyon, 1013 Baquera Ct., Roseville, Calif. 95678

[21] Appl. No.: 380,827

[22] Filed: Jan. 30, 1995

[51] Int. Cl.[6] ..... B65B 5/00; B65D 85/18; A45C 11/00

[52] U.S. Cl. ..... 206/527; 206/278

[58] Field of Search ..... 383/23; 206/278, 206/279, 287, 287.1, 527; 190/40, 100, 110

[56] References Cited

U.S. PATENT DOCUMENTS

| | | | |
|---|---|---|---|
| 898,026 | 9/1908 | Wilson | 190/40 X |
| 1,203,042 | 10/1916 | Parnass | 206/287 |
| 2,132,337 | 10/1938 | Whiteman | 206/287 X |
| 2,590,462 | 3/1952 | Rassenfoss | 383/23 X |
| 2,699,235 | 1/1955 | Chesnut | 190/110 X |
| 4,580,667 | 4/1986 | Herwood | 190/110 |
| 4,854,431 | 8/1989 | Pulichino, Jr. et al. | 190/110 X |
| 4,923,745 | 5/1990 | Wolfert et al. | 206/287 X |
| 5,002,183 | 3/1991 | Okano | 206/287 |
| 5,090,559 | 2/1992 | Gendreau | 383/23 |
| 5,350,045 | 9/1994 | Robertson | 190/110 |

FOREIGN PATENT DOCUMENTS

| | | | |
|---|---|---|---|
| 2653312 | 4/1991 | France | 190/110 |
| 1273768 | 7/1968 | Germany | 206/287 |
| 3338676 | 5/1985 | Germany | 206/278 |
| 187394 | 1/1937 | Switzerland | 206/287 |
| 440673 | 1/1936 | United Kingdom | 206/287 |
| 2097668 | 11/1982 | United Kingdom | 206/278 |
| 2243764 | 11/1991 | United Kingdom | 206/287.1 |

OTHER PUBLICATIONS

Wheary Modernized Luggage Catalog 1936, p. 5 Wheary Trunk Company, Racine, WI.

Gilford, Judith, *The Packing Book*, Ten Speed Press, 1994.

Massow, Rosalind, *Travel Easy*, AARP (American Association for Retired People), 1987.

*Primary Examiner*—Sue A. Weaver

*Attorney, Agent, or Firm*—Thomas A. Gallagher

[57] ABSTRACT

A method of packing garments for transportation or storage in which each garment is enclosed unfolded inside its own garment cover, the garment cover commensurate in size with the garment and the garment cover formed from a low-friction fabric material. The garment covers are packed adjacent one another in luggage, thereby reducing friction between the garments so that fewer wrinkles in the garments occur when they are transported or stored.

1 Claim, 4 Drawing Sheets

WRINKLE PREVENTING METHOD OF PACKING GARMENTS FOR TRANSPORTATION OR STORAGE

BACKGROUND—FIELD OF INVENTION

This invention relates to the prevention of wrinkles produced on garments as a result of being packed in luggage.

BACKGROUND—DESCRIPTION OF PRIOR ART

One of the most common problems to plague travelers is wrinkled clothing after unpacking their luggage.

Until now, there has been no effective product on the market to help prevent wrinkles from occurring on packed or tightly stored clothing, such as in luggage. Many products, however, exist that help the traveler deal with the problem after it has occurred. Some of the items are travel irons, steamers, wrinkle "removing" sprays etc. Some luggage manufacturers have attempted to design their products to help prevent wrinkles, but have been obviously unsuccessful. This can be easily proven by asking any traveler if they have problems with wrinkled clothing regardless of what type of luggage they are using. The answer is invariably a resounding yes.

This problem is definitely recognized by the travel industry. This can be seen by the many products deal with wrinkled clothing. These products fall into one of two categories; wrinkle removal and wrinkle prevention. Since this invention deals with wrinkle prevention, I will only address prior art that deals with wrinkle prevention.

Any prior art mentioned was discovered only by my own awareness of the current products on the market. No patent search was done by myself or any person or organization on behalf of myself, the sole inventor. While the below stated prior art does attempt to deal with the prevention of wrinkled clothing, to my knowledge there is no prior art that is similar to the form and function of the invention described in this patent application.

To my knowledge, the only products on the market that deal with wrinkle prevention are mechanisms designed into the luggage itself and are not separate products that can be used in conjunction with various types of luggage. The types of mechanisms referred to above are typically belts, straps and foam bars that are designed to hold the clothing in place during travel. These mechanisms are usually ineffective and can actually cause wrinkles.

With a little thought, one can quickly understand why wrinkles occur. When clothes are packed together, they invariably rub against each other and create deformities in the material which causes wrinkles. With this fact in mind, some frequent travelers use a practices that are known to significantly reduce wrinkles on their packed garments.

The two most well known methods are wrapping each individual item in the cellophane that dry cleaners typically use to wrap the cleaned garments in after cleaning. This simply reduces the amount of friction between the items of clothing and therefore significantly reduces the wrinkling of the garments. There are however a couple of problems with this. Many people don't get their clothes dry cleaned before every trip they take, and therefore can't take advantage of the pre-wrapped clothes. Next, wrapping the clothes every time with this temporary and costly cellophane is cumbersome and time consuming, therefore many people would rather deal with the wrinkles. Another practice is to turn the clothes inside out. This only works if the clothes are lined with a slippery, non-friction material.

OBJECTIVES AND MARKINGS

Both of the practices mentioned above address a problem that is caused by friction between clothing, and both can significantly help reduce wrinkles if applied correctly. This invention is based on a proven concept; reduce the friction between articles of clothing and wrinkles will be prevented. This situation begs for a specific, affordable, easy to use product to be placed on the market to solve this perennial problem faced by thousands of people every day. This patent application is for a product that addresses all of these problems. An easy to use, affordable, effective and durable low-friction wrinkle prevention garment cover.

Several objects and advantages of this invention are:

(a) to provide a garment cover that significantly helps to prevent wrinkles on packed or stored garments.

(b) said invention in (a) to be simple to use with little effort and time (c) said invention in (a) is not a "built in" part of a piece of luggage, and can therefore be used separately or in conjunction with any type of luggage.

(d) said invention in (a) to be cost effective (e) said invention in (a) to be reusable and durable (f) said invention in (a) can also be used to provided protection of the garment from bugs, dirt and other undesirables.

Further objects and advantages of my invention will become apparent from a consideration of the drawings and ensuing description.

SUMMARY

My invention, a wrinkle prevention garment cover, is the only product of its kind that significantly reduces wrinkling of packed or tightly stored clothing. Prior art attempts to deal with the wrinkling problem by either reducing the movement of clothing when packed, which in itself can cause wrinkles, or deals with the removal of wrinkles after the fact. My invention is truly novel in that it significantly reduces the friction between adjacent articles of clothing which prevents the wrinkling of those garments. This easy to use, reusable and effective product will make storage of clothing, and especially for travelers, much easier for thousands of people.

DRAWING FIGURES

REFERENCE NUMERALS IN DRAWINGS

10. Main body of garment cover

Figure 1B:
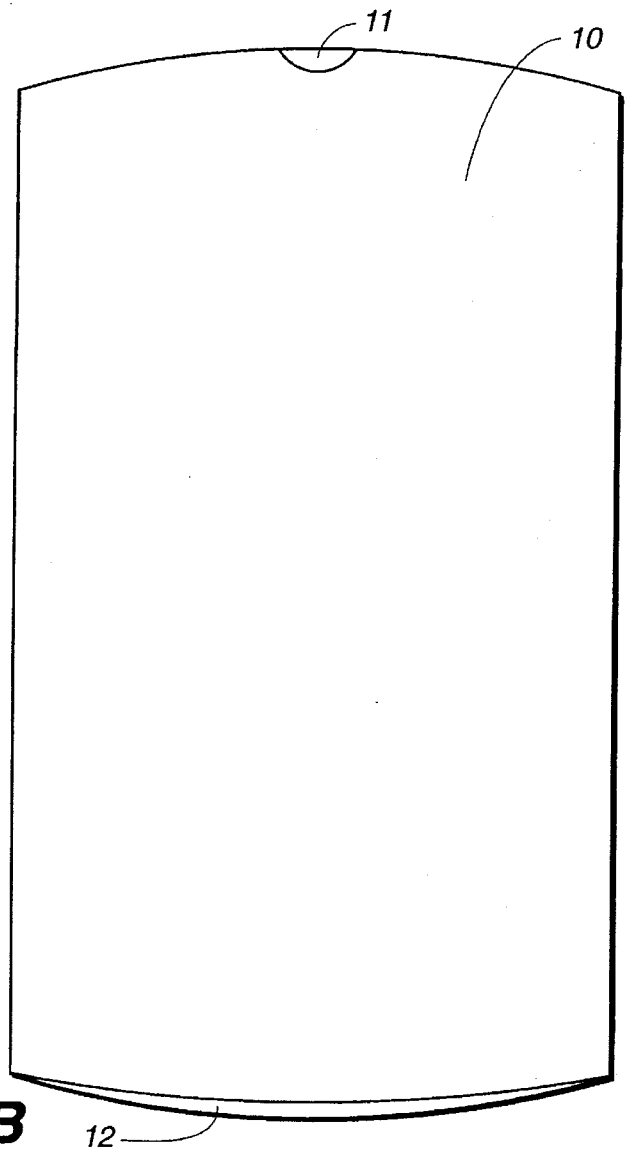
FIG. 1B shows the front (or back) view of the wrinkle preventing garment in a standard size with no fastening mechanisms.

11. Top opening to accommodate the hook portion of standard size clothing hanger.

12. Bottom opening of garment cover with no closure means for fastening bottom closed

13. Vertical zipper spanning garment cover from top to bottom

14. Left side flap

15. Right side flap

16. Long Velcro strip

17. Short Velcro strip

18. Gap between left and right side flaps

19. Back side of garment cover

20. Front side of garment cover

21. Zipper for bottom opening of garment cover

DESCRIPTION—FIGS. 1 TO 5

Figure 1A:
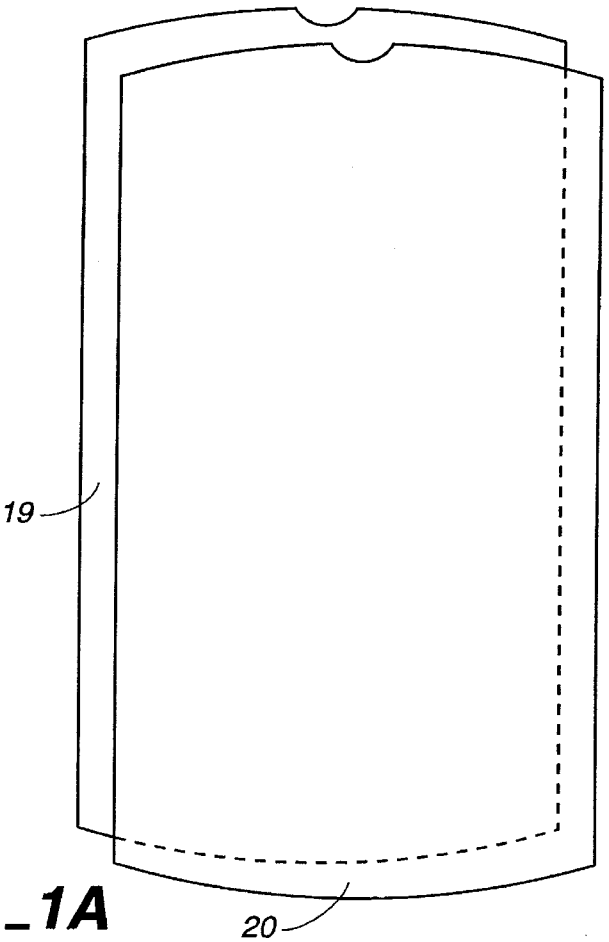
FIG. 1A shows the two shaped pieces of fabric to be sewn together.

The typical embodiment of the wrinkle preventing garment cover is illustrated in FIG. 1B. This shows the standard, or regular size of the garment cover with an opening at the top (11) to accommodate the hook portion of a standard size clothing hanger. The bottom opening (12) is meant to be left open and is without a mechanism for closure. FIG. 1A shows the backside portion (19) and front side portion (20) of the garment cover before assembly. The dashed lines indicate where the two portions would be sewn together. The other embodiments (except for FIG. 4) that follow would be constructed in the same manner. Two individual pieces of low-friction fabric such as Satin would be sewn together around the perimeter of the garment cover except where openings are present.

Figure 2:
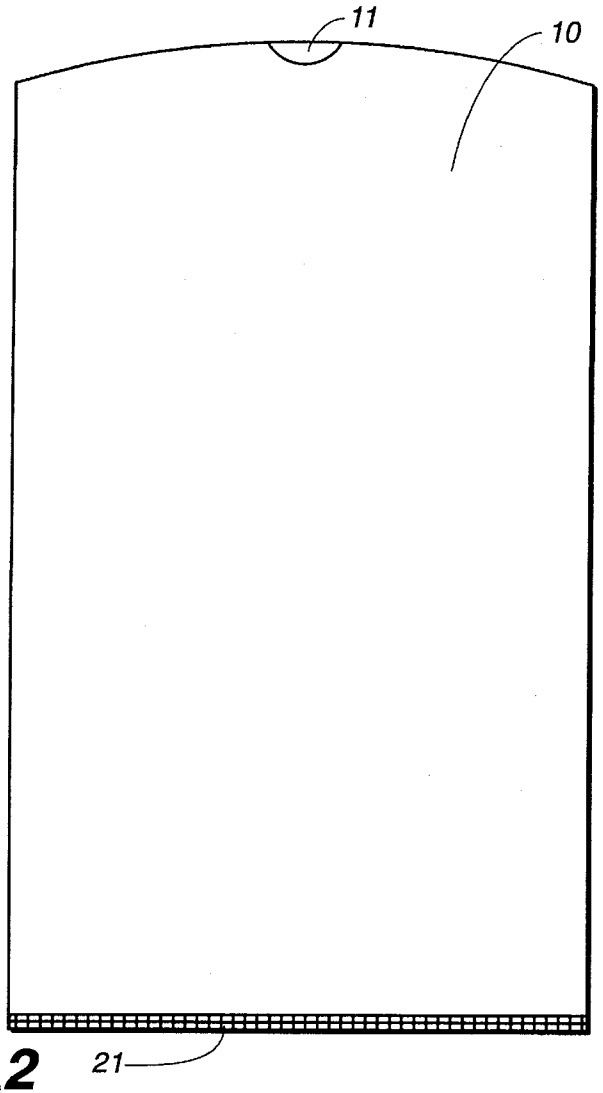
FIG. 2 shows the garment cover with the addition of a zippered bottom.

FIG. 2 is showing the same embodiment in FIG. 1A with the addition of a zipper for the the bottom portion of the garment cover. The zipper can be attached to the garment cover using traditional methods such as sewing.

Figure 3:
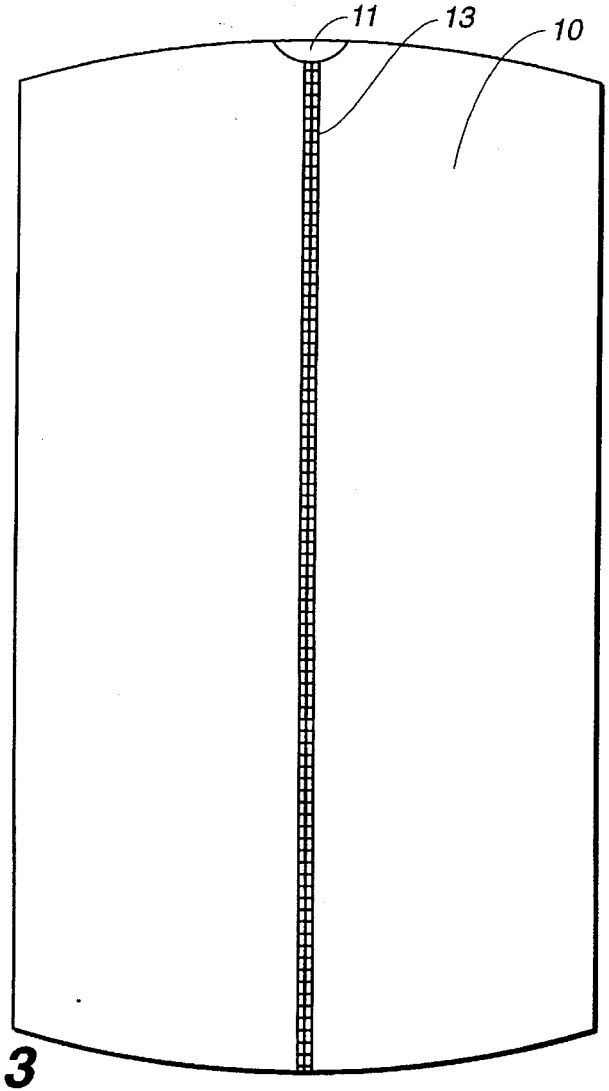
FIG. 3 shows the front of garment cover with a zippered section spanning the garment cover from top to bottom.

FIG. 3 is showing the garment cover with a zipper that spans the garment cover from the top to the bottom. The zipper can be attached to the garment cover using traditional methods such as sewing. The bottom of the garment cover is permanently closed.

Figure 4:
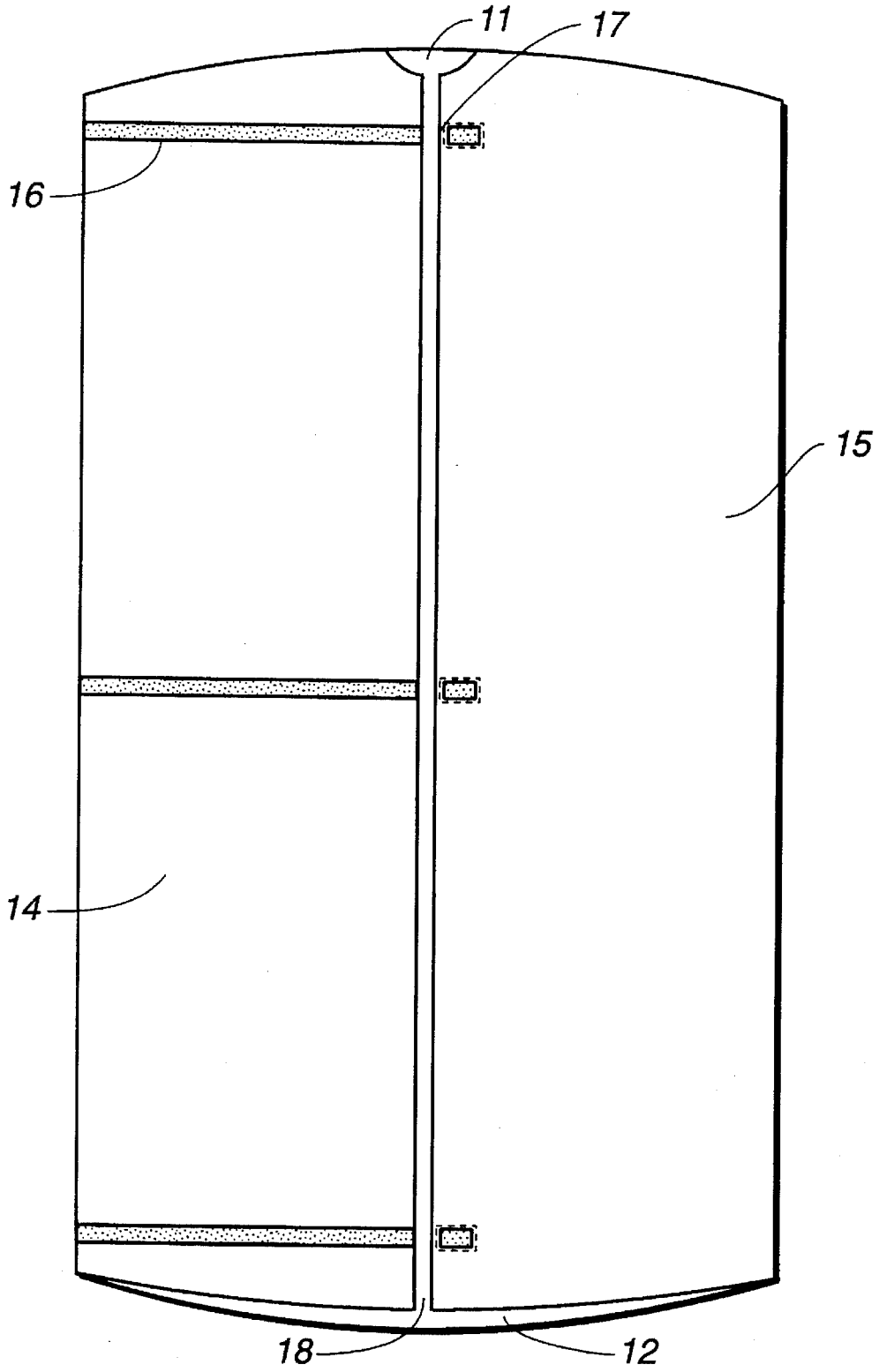
FIG. 4 shows the front of garment cover with Velcro strips on either flap.

FIG. 4 shows the garment cover that utilizes Velcro to keep the garment cover closed. Velcro strips (16) and (17) attached to the left flap (14) and the right flap (15) of the garment cover respectively. The Velcro strips could be attached to the flaps of the garment cover by sewing or gluing the back of the Velcro strip to the fabric of the garment cover. The smaller Velcro strips (17) are located on the inside of the right flap (15). This is indicated by the dashed lines surrounding the small Velcro strips. The entire body of the garment cover is one solid piece of material.

Figure 5:
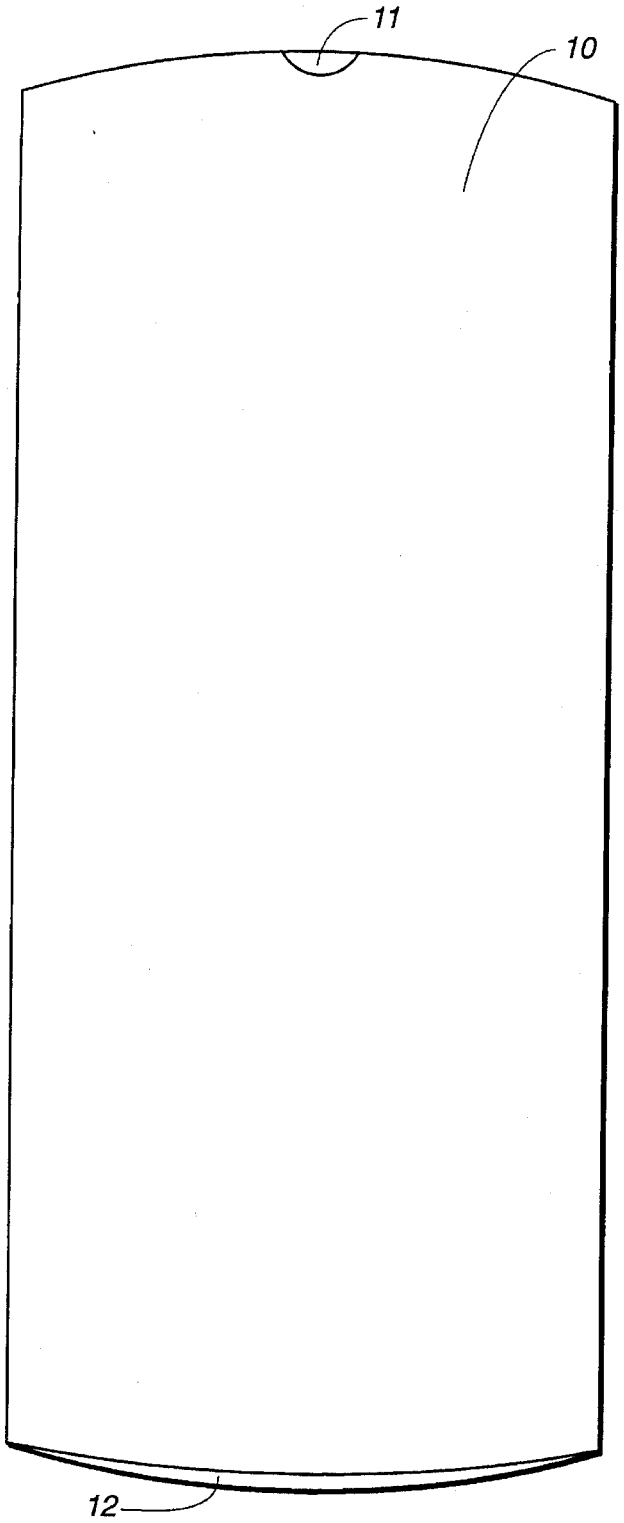
FIG. 5 shows the garment cover in a long size.
Figure 6:
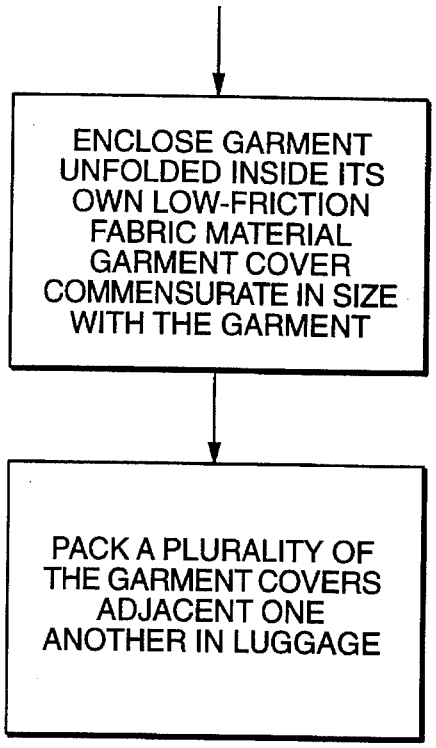
FIG. 6 is a flow chart showing the method of the present invention.

FIG. 5 illustrates the garment cover in FIG. 1A but in a longer size to accommodate longer garments such as dresses.

OPERATION OF INVENTION

Although the following embodiments offer different benefits and are used differently, a typical example of how this invention would be used by a traveling business person, for example, is as follows:

1. Person would place garment, usually on a hanger, inside the garment cover and allow the hook portion of the hanger to be exposed through the opening at the top of the garment cover.

2. Articles covered with the wrinkle prevention garment cover can now be packed into luggage.

3. This invention also provides other benefits such as protection from dirt, bugs, etc. Therefore it would be beneficial to store clothes, such as in a closet, in the wrinkle preventing garment cover even if wrinkles are not a concern.

Note: One wrinkle preventing garment cover should be used for each article of clothing for maximum effectiveness.

The manner of using the wrinkle prevention garment cover illustrated in FIG. 1A, the most typical embodiment of this invention, is simple. In essence, the opening at the bottom of the garment cover (12) will allow the garment cover to slip over and cover a piece of clothing placed on any regular size hanger. A hanger is not required, but will typically be used. The opening at the top of the garment cover (11) will allow the hook of the clothing hanger to be exposed at the top. The entire garment should be covered at this point.

The manner of using the wrinkle prevention garment cover illustrated in FIG. 2 will be the same as that of FIG. 1A except a zipper is use to close the bottom portion of the garment cover. While the main benefit of this invention is the prevention of wrinkles, this provides protection of the garment from bugs, dirt and other undesirables.

The manner of using the wrinkle prevention garment cover illustrated in FIG. 3 differs from that of FIG. 1A in that the garment cover can he opened up. The garment can then be placed inside the garment cover and then zipped up inside. While the main benefit of this invention is the prevention of wrinkles, this provides protection of the garment from bugs, dirt and other undesirables.

The embodiment in FIG. 4 allows the garment cover to be closed with the tightness being adjustable. This is accomplished via the long Velcro strips (16) located on the left side flap (14) and the short Velcro strip (17) located on the right side flap (15). The longer Velcro strips (16) allow for one side of the garment cover to overlap the opposite side by varying degrees.

The manner of using the wrinkle prevention garment cover illustrated in FIG. 5 is the same as for FIG. 1, except the longer length of the garment cover in FIG. 5 can accommodate longer clothing such as dresses.

THEORY OF OPERATION

Clothing that has been packed or stored typically gets wrinkled due to the friction between adjacent items of clothing. When friction occurs, the fabric is deformed and wrinkles can occur. This invention uses a low-friction material to comprise the garment cover. By covering each individual garment with this low-friction material, wrinkles in the clothing are much less likely to occur when tightly stored or packed in luggage.

CONCLUSIONS, RAMIFICATIONS, AND SCOPE OF INVENTION

Thus the reader will see that wrinkle prevention garment cover is a truly novel invention in that it solves the perennial problem of wrinkled clothing by reducing the friction between adjacent articles of clothing when packed or stored.

This invention provides a viable solution to this problem due to its ease of use, and effectiveness.

While my above description may contain many specificity's, these should not be construed as limitations on the scope of the invention, but rather as an exemplification of one preferred embodiment thereof. Many other variations are possible. For example this invention could manifested in many types of low-friction fabrics, colors, patterns, sizes, shapes, a closure mechanism could be employed at the bottom, top or sides of garment cover, the fabric could be treated with scents or odors for repelling insects or bugs. Thus, the scope of the invention should be determined not to be the embodiment(s) illustrated, or examples given, but by the appended claims and their legal equivalents.

I claim:

1. A method of packing garments for transportation or storage comprising enclosing unfolded each garment inside its own garment cover, the garment cover commensurate in size with the garment and the garment cover formed from a low-friction fabric material, and packing the garment covers adjacent one another in luggage, whereby friction between the garments is reduced so that fewer wrinkles in the garments occur when they are transported or stored.

* * * * *